US007993120B2

(12) United States Patent
Bush

(10) Patent No.: US 7,993,120 B2
(45) Date of Patent: Aug. 9, 2011

(54) SLIDE VALVE

(75) Inventor: James W. Bush, Skaneateles, NY (US)

(73) Assignee: Carrier Corporation, Farmington, CT (US)

( * ) Notice: Subject to any disclaimer, the term of this patent is extended or adjusted under 35 U.S.C. 154(b) by 511 days.

(21) Appl. No.: 11/997,346

(22) PCT Filed: Sep. 7, 2005

(86) PCT No.: PCT/US2005/031992

§ 371 (c)(1),
(2), (4) Date: Jan. 30, 2008

(87) PCT Pub. No.: WO2007/030114

PCT Pub. Date: Mar. 15, 2007

(65) Prior Publication Data

US 2008/0206086 A1 Aug. 28, 2008

(51) Int. Cl.
*F03C 2/00* (2006.01)
*F03C 4/00* (2006.01)

(52) U.S. Cl. ..... 418/201.2; 418/1; 418/201.1; 418/178

(58) Field of Classification Search ..... 418/201.1, 418/201.2, 152, 156, 178, 179, 270, 1; 137/375
See application file for complete search history.

(56) References Cited

U.S. PATENT DOCUMENTS

| | | | | |
|---|---|---|---|---|
| 2,202,735 | A | 5/1940 | Johnson | |
| 3,088,659 | A | 5/1963 | Nilsson et al. | |
| 4,249,866 | A | 2/1981 | Shaw et al. | |
| 4,453,900 | A * | 6/1984 | Schibbye et al. | 418/201.2 |
| 4,515,540 | A | 5/1985 | Pillis | |
| 5,860,801 | A * | 1/1999 | Timuska | 418/201.2 |
| 6,022,203 | A * | 2/2000 | Kirsten | 418/201.2 |
| 6,302,668 | B1 * | 10/2001 | Lee | 418/201.2 |
| 6,739,853 | B1 | 5/2004 | Tang et al. | |

FOREIGN PATENT DOCUMENTS

| | | | |
|---|---|---|---|
| CN | 1240017 | A | 12/1999 |
| CN | 1615184 | A | 5/2005 |
| DE | 4014851 | A1 | 11/1991 |
| JP | 59131791 | A * | 7/1984 |
| JP | 05087071 | A * | 4/1993 |

OTHER PUBLICATIONS

Chinese Office Action for CN200580051503.0, dated Mar. 6, 2009.

* cited by examiner

*Primary Examiner* — Theresa Trieu
(74) *Attorney, Agent, or Firm* — Bachman & LaPointe, P.C.

(57) ABSTRACT

A compressor (20) has at least a first rotor (26; 28) at least partially within a bore (276; 278) of a housing. A slide valve element (102; 300) is positioned at least partially within a channel (200; 301) in the housing and has a first surface facing the first rotor. The slide valve element includes a body (268; 302) and a coating (270; 306) on the body. The coating forms the first surface.

20 Claims, 4 Drawing Sheets

SLIDE VALVE

BACKGROUND OF THE INVENTION

The invention relates to compressors. More particularly, the invention relates to refrigerant compressors.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port.

It is often desirable to temporarily reduce the refrigerant mass flow through the compressor by delaying the closing off of the inlet port when full capacity operation is not required. Such unloading is often provided by a slide valve having a moveable port element with one or more portions whose positions (as the valve is translated) control the respective suction side closing and discharge side opening of the compression pockets. The primary effect of an unloading shift of the slide valve is to reduce the initial trapped suction volume (and hence compressor capacity). Exemplary slide valves are disclosed in U.S. Patent Application Publication No. 20040109782 A1 and U.S. Pat. Nos. 4,249,866 and 6,302,668. In a typical such compressor, the slide valve element is mounted for reciprocal movement in a partially circular bore parallel to the rotor bores.

SUMMARY OF THE INVENTION

According to one aspect of the invention, a screw compressor has at least a first rotor at least partially within a bore of a housing. A slide valve element is positioned at least partially within a channel in the housing and has a first surface facing the first rotor. The slide valve element includes a body and a coating on the body. The coating forms the first surface.

In various implementations the coating may have the characteristic thickness of at least 0.015 mm. The coating may be softer than a principal material of the first rotor. The coating may comprise a metal-organic mix. The coating may comprise a metallic coating. The coating may comprise a non-metallic coating. The slide valve may be linearly translatable through a continuum of positions so as to provide a continuous volume index adjustment between first and second indices. A second rotor may be enmeshed with the first rotor. The coating may also form a second surface of the slide valve element facing the second rotor. The housing may include a body portion with a channel accommodating the valve element and a cover plate covering the channel and retaining the valve element in the channel.

Another aspect of the invention involves a compressor having a housing and a first rotor at least partially within a bore of the housing. A slide valve element is at least partially within a channel in the housing. The channel extends through the housing body piece. A cover is secured to the housing body piece to close an outboard portion of the channel. The slide valve element has an inboard first portion and a second portion outboard of the first portion and wider than the first portion. The slide valve second portion is accommodated within the channel outboard portion.

Another aspect of the invention involves a method including applying a coating to a slide valve element body. The slide valve element is installed to a housing of a screw compressor. At least one rotor of the screw compressor is driven so as to wear down the coating.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
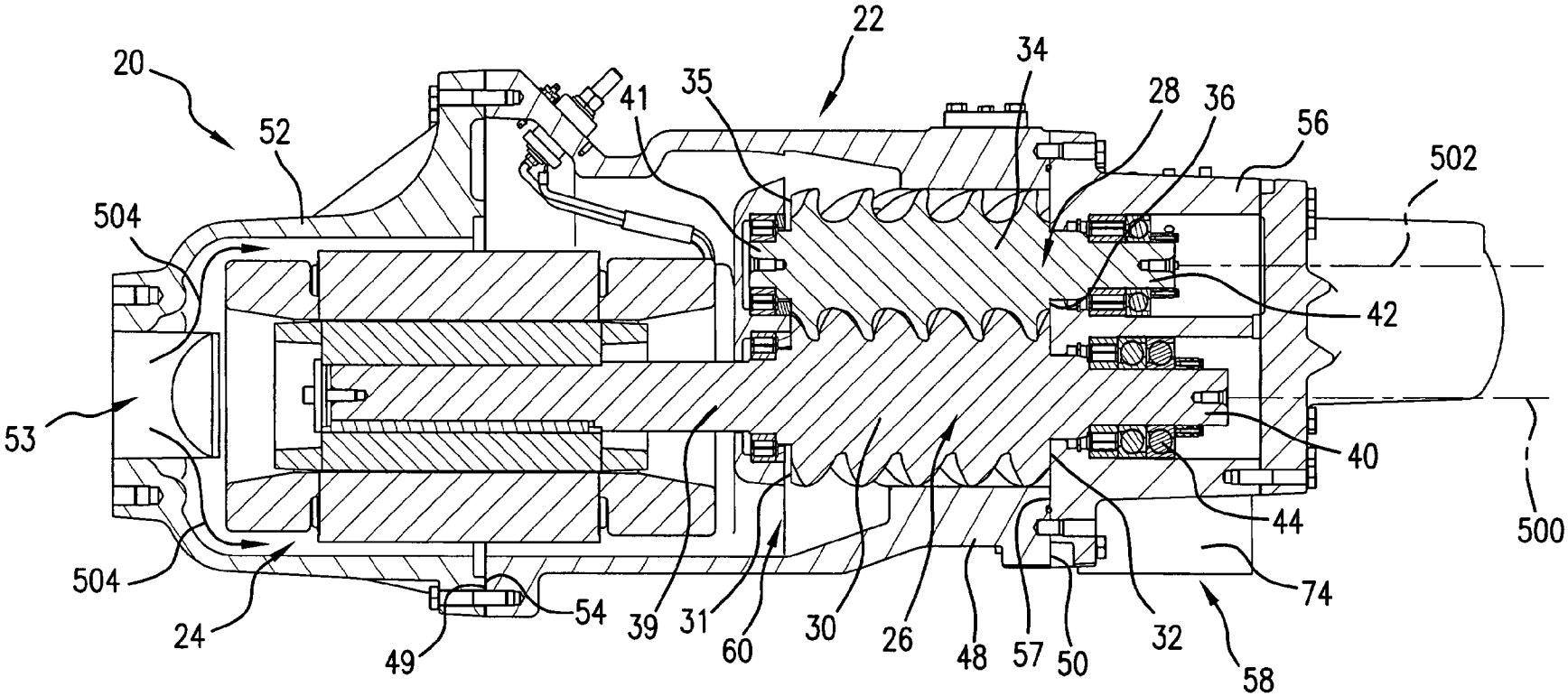
FIG. 1 is a longitudinal sectional view of a compressor.

FIG. 1 shows a compressor 20 having a housing assembly 22 containing a motor 24 driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies 44 for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 48 having an upstream/inlet end face 49 approximately midway along the motor length and a downstream/discharge end face 50 essentially coplanar with the rotor body ends 32 and 36. Many other configurations are possible.

The exemplary housing assembly 22 further comprises a motor/inlet housing 52 having a compressor inlet/suction port 53 at an upstream end and having a downstream face 54 mounted to the rotor housing upstream face 49 (e.g., by bolts through both housing pieces). The assembly 22 further includes a discharge housing 56 having an upstream face 57 mounted to the rotor housing downstream face 50 and having a discharge port 58. The exemplary rotor housing 48, motor/inlet housing 52, and discharge housing 56 may each be formed as castings subject to further finish machining.

Figure 2:
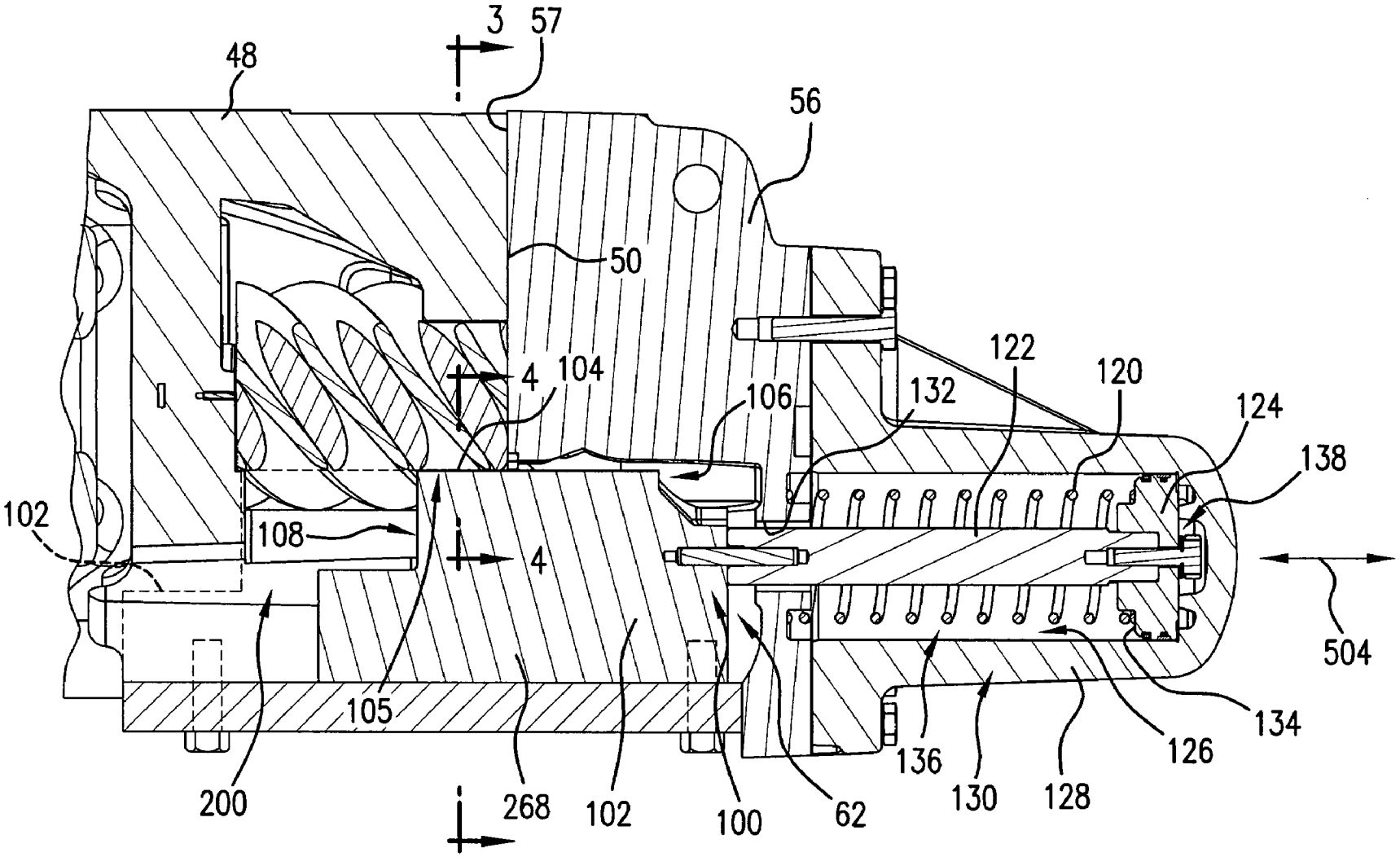
FIG. 2 is a partial longitudinal sectional view of the compressor of FIG. 1.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62 (FIG. 2). A series of pairs of. male and female compression pockets are formed by the housing assembly 22, male rotor body 30 and female rotor body 34. Each compression pocket is bounded by external surfaces of enmeshed rotors, by portions of cylindrical surfaces of male and female rotor bore surfaces in the rotor case and continuations thereof along a slide valve, and portions of face 57.

For capacity control/unloading, the compressor has a slide valve 100 (FIG. 2) having a valve element 102. The valve element 102 has a portion 104 along the mesh zone between the rotors (i.e., along the high pressure cusp 105). The exemplary valve element has a first portion 106 at the discharge plenum and a second portion 108 at the suction plenum. The valve element is shiftable to control compressor capacity to provide unloading. The exemplary valve is shifted via linear translation parallel to the rotor axes between fully loaded and fully unloaded positions/conditions. The valve element 102 is held for reciprocal movement between a first position and a second position. The exemplary movement is along a direction 504 parallel to the axes 500 and 502.

FIG. 2 shows the valve element at a downstream-most position in its range of motion. An upstream-most position is shown in broken lines. In the upstream-most position, the compression pockets close relatively upstream and capacity is a relative maximum (e.g., at least 90% of a maximum displacement volume for the rotors, and often about 99%). In the downstream-most position, capacity is reduced to provide an unloaded condition (e.g., to a displacement volume typically less than 40% of the loaded displacement volume or the maximum displacement volume, and often less than 30%).

In the exemplary slide valve, shifts between the two positions are driven by a combination of spring force and fluid pressure. A main spring 120 biases the valve element from the loaded to the unloaded positions. In the exemplary valve, the spring 120 is a metal coil spring surrounding a shaft 122 coupling the valve element to a piston 124. The piston is mounted within a bore (interior) 126 of a cylinder 128 formed in a slide case element 130 attached to the discharge housing 56. The shaft passes through an aperture 132 in the discharge housing 56. The spring is compressed between an underside 134 of the piston and the discharge housing 56. A proximal portion 136 of the cylinder interior is in pressure-balancing fluid communication with the discharge plenum via clearance between the aperture and shaft. A headspace 138 is coupled via electronically-controlled solenoid valves (not shown schematically) to a high pressure fluid source (not shown schematically) at or near discharge conditions (e.g., to an oil separator). Other actuators (e.g., direct solenoid actuation, direct hydraulic actuation, drive screw actuation, and the like) are possible.

Figure 3:
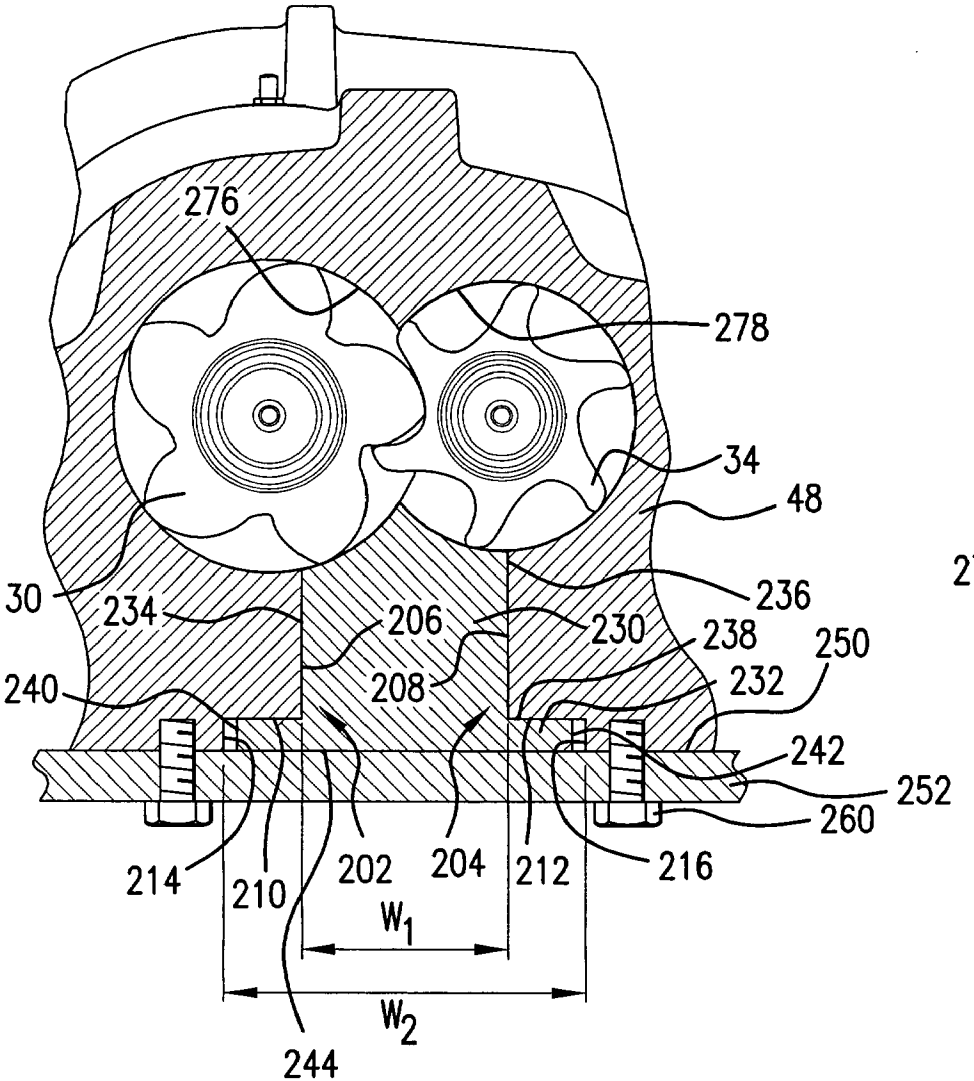
FIG. 3 is a partial transverse sectional view of the compressor of FIG. 2, taken along line 3-3 and showing a valve element.

In the exemplary embodiment, the slide valve element is held substantially within a channel in the housing. The exemplary channel 200 spans portions of the rotor case 48 and discharge housing 56 and is laterally defined by stepped sidewalls 202 and 204 (FIG. 3). Each sidewall 202 and 204 respectively has a proximal portion 206 and 208, a shoulder 210 and 212 and a distal portion 214 and 216. The proximal portions are parallel to each other and spaced apart by a width $W_1$. The distal portions are parallel to each other and the proximal portions and are spaced apart by a width $W_2$. The intermediate shoulder portions are coplanar and perpendicular to the proximal and distal portions.

FIG. 3 further shows the valve element 102 as including inboard and outboard portions 230 and 232. The inboard portion has respective side surfaces 234 and 236 in sliding engagement with the surfaces 206 and 208. The outboard portion includes an underside 238 in sliding engagement with the shoulder surface 212. The outboard portion 232 further includes lateral surfaces 240 and 242. In the exemplary embodiment, these are spaced slightly apart from the adjacent surfaces 214 and 216. The outboard portion 232 further includes an outboard surface 244 in sliding engagement with the underside 250 of a cover plate 252 which may be secured to the rotor housing 48 and discharge housing 56 such as by bolts 260.

Figure 4:
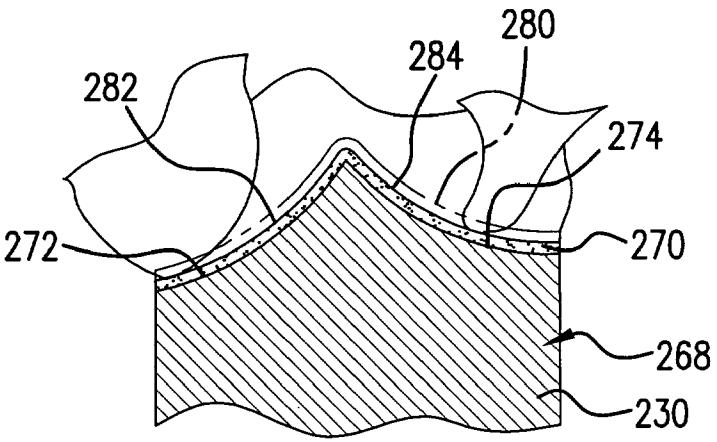
FIG. 4 is an enlarged view partial transverse sectional of the valve element of the compressor of FIG. 2, taken along line 4-4.

The exemplary valve element 102 includes a unitarily-formed metallic body 268 with a deformable coating 270 (FIG. 4) for engaging the rotor lobes. Along the inboard portion 230, the metallic body has cylindrical concave surfaces 272 and 274 adjacent and slightly spaced apart from the sweep of the rotor bodies 30 and 34, respectively. As is discussed below, these surfaces 272 and 274 may, respectively, be spaced radially beyond the rotor bore surfaces 276 and 278.

The material 270 is formed atop (e.g., as a built-up coating) the surfaces 272 and 274 prior to assembly and may have an initial surface contour 280 effective to interfere with the bodies 30 and 34. Rotation of the lobed rotor bodies 30 and 34 will thus be effective to abrade the material 270 to create cylindrical surfaces 282 and 284 along the lobe-swept periphery. An exemplary post-abrasion thickness of the material 270 is 0.010-0.100 mm (more narrowly 0.010-0.025 mm). An exemplary as-applied thickness may be 25% or more greater on average (e.g., 25-100%). Exemplary material is an aluminum-polymer amalgam applied by a spray coating process. Alternative metallic coatings include aluminum foams and zinc-nickel electroplatings. Alternative non-metallic coatings include resinous and other polymeric coatings.

Use of the material 270 permits greater manufacturing tolerance (e.g., in one or all of position, shape/roundness, and finish) for the surfaces 272 and 274 relative to corresponding surfaces of an uncoated valve element. Thus the nominal positions of the surfaces 272 and 274 may be shifted slightly outward relative to the rotor bore surfaces 276 and 278, respectively.

Other cost savings may be introduced by mounting the valve element in an open channel (closed by the cover plate 252) rather than in a circular bore intersecting the rotor bores. The precise machining of flat surfaces may be easier than the machining of the circular cylindrical surfaces. Furthermore, especially if combined with use of the abradable material 270, less precision is needed.

Figure 5:
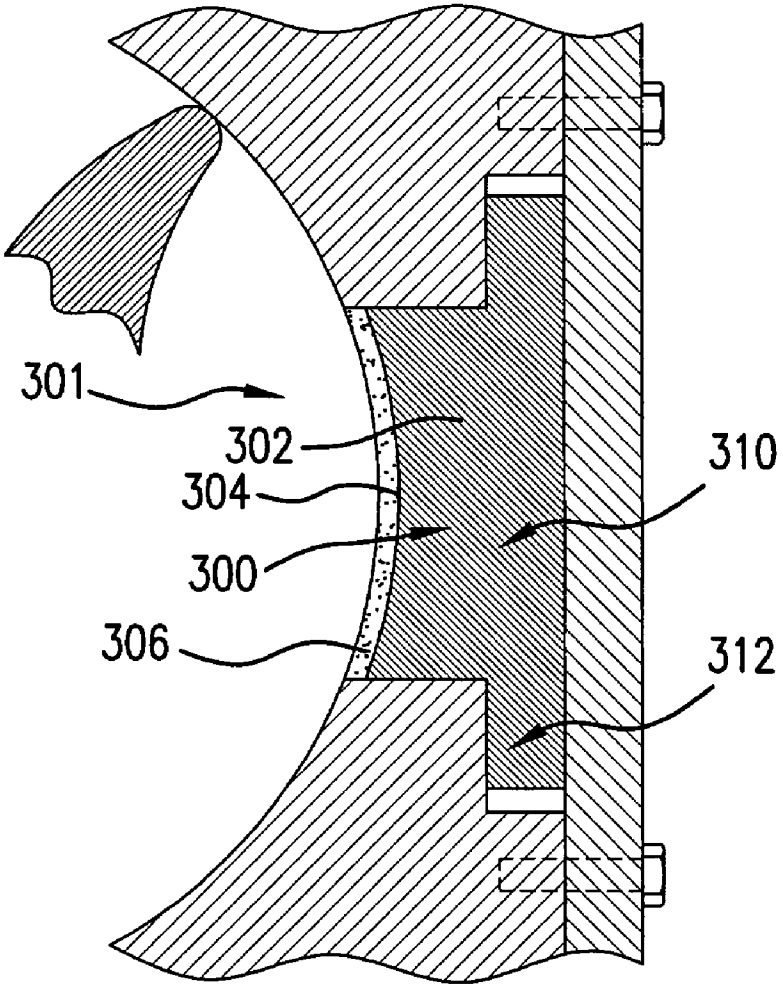
FIG. 5 is a partial transverse sectional view of an alternate valve element.

FIG. 5 shows an alternate valve element 300 in a channel 301 along a single rotor bore rather than a mesh between rotor bores. The valve 300 has a metallic body 302 otherwise similar to the body 268 but having a single concave cylindrical surface 304 carrying a coating material 306. The element has inboard and outboard portions 310 and 312. Manufacture, installation, and operation, may be similar to those of the valve element 102.

One or more embodiments of the present invention have been described. Nevertheless, it will be understood that various modifications may be made without departing from the spirit and scope of the invention. For example, the principles may be implemented as a modification of an existing compressor configuration. In such an implementation, details of the existing configuration may influence details of the particular implementation. Accordingly, other embodiments are within the scope of the following claims.

What is claimed is:

1. A compressor (20) comprising:

a housing (22);

a first rotor (26; 28) at least partially within a bore (276; 278) of the housing; and a slide valve element (102; 300) at least partially within a channel in the housing and having a first surface facing the first rotor, the slide valve element being linearly translatable parallel to an axis of the first rotor through a continuum of positions so as to provide a continuous volume index adjustment between first and second indices, wherein:

the slide valve comprises:

a body (268; 302); and a coating (270; 306) on the body and forming the first surface.

2. The compressor (20) of claim 1 wherein:

the coating has a characteristic thickness of at least 0.015 mm.

3. The compressor (20) of claim 1 wherein:

the coating is softer than a principal material of the first rotor.

4. The compressor (20) of claim 1 wherein the coating comprises a metal-organic mix.

5. The compressor (20) of claim 1 wherein the coating comprises a non-metallic coating.

6. The compressor (20) of claim 1 further comprising a second rotor (28; 26) enmeshed with the first rotor (26; 28) and wherein the coating also forms a second surface of the slide valve element facing the second rotor.

7. The compressor (20) of claim 1 wherein the housing comprises:

a body portion with a channel accommodating the valve element; and a cover plate covering the channel and retaining the valve element in the channel.

8. A compressor (20) comprising:

a housing (22);

a first rotor (26; 28) at least partially within a bore (276; 278) of the housing; and a slide valve element (102; 300) at least partially within a channel (200; 301) in the housing, the slide valve being shiftable via linear translation parallel to an axis of the first rotor, wherein:

the channel extends through a housing body piece;

a cover (252) is secured to the housing body piece to close an outboard portion of the channel; and the slide valve element has:

an inboard first portion (230; 310); and a second portion (232; 312) outboard of the first portion and wider than the first portion and accommodated within the channel outboard portion.

9. The compressor (20) of claim 8 further comprising:

a second rotor (28; 26) enmeshed with the first, the slide valve first portion proximate a mesh zone of the first and second rotors.

10. The compressor (20) of claim 8 wherein:

the outboard portion of the channel has a pair of coplanar base surface portions on opposite sides of an inboard portion of the channel.

11. The compressor (20) of claim 8 wherein:

the valve element second portion has a flat outboard surface in sliding engagement with an inboard surface of the cover.

12. The compressor (20) of claim 8 wherein:

the valve element first portion has a coating facing the first rotor.

13. A method comprising:

applying a coating (270; 306) to a slide valve element body (268; 302);

installing the slide valve element to a housing (22) of a screw compressor (20), the slide valve element being linearly translatable through a continuum of positions so as to provide a continuous volume index adjustment; and driving at least one rotor (26; 28) of the screw compressor about an axis parallel to a direction of the slide valve element linear translation so as to wear down the coating.

14. The method of claim 13 further comprising:

machining a planar valve-engaging surface (212; 214) of the housing.

15. The method of claim 14 wherein the planar valve-engaging surface is parallel to said axis.

16. The method of claim 13 wherein the applying comprises:

spray coating or flame-spray coating.

17. The method of claim 13 wherein the installing comprises:

placing the slide valve element in a channel (200; 301) in a body of the housing; and securing a cover (252) over the channel.

18. The method of claim 17 wherein the slide valve element has an outboard portion (232) having an outboard surface (244) in sliding engagement with an underside (250) of the cover (252).

19. The method of claim 13 wherein the coating has an as-applied thickness of at least 0.015 mm at least at one location.

20. The method of claim 13 wherein the coating is worn down by at least 0.010 mm at least at one location.

* * * * *